US007867584B2

(12) United States Patent
Bi et al.

(10) Patent No.: US 7,867,584 B2
(45) Date of Patent: Jan. 11, 2011

(54) INK-JET RECORDING MEDIUM FOR DYE- OR PIGMENT-BASED INK-JET INKS

(75) Inventors: Yubai Bi, San Diego, CA (US); Tienteh Chen, San Diego, CA (US); Eric Lee Burch, San Diego, CA (US); Sandeep Bangaru, San Diego, CA (US); Kimberly Zargarian, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 571 days.

(21) Appl. No.: 11/165,627

(22) Filed: Jun. 24, 2005

(65) Prior Publication Data

US 2005/0276936 A1 Dec. 15, 2005

Related U.S. Application Data

(63) Continuation-in-part of application No. 11/110,106, filed on Apr. 19, 2005, which is a continuation-in-part of application No. 10/854,350, filed on May 26, 2004.

(51) Int. Cl.
*B41M 5/00* (2006.01)

(52) U.S. Cl. ..... 428/32.16; 428/32.17; 428/32.21; 428/32.26; 428/32.28; 428/32.3; 428/32.34

(58) Field of Classification Search ..... 428/32.16, 428/32.17, 32.21, 32.26, 32.28, 32.3, 32.34
See application file for complete search history.

(56) References Cited

U.S. PATENT DOCUMENTS 6,129,785 A * 10/2000 Schliesman et al. ..... 106/482
6,183,851 B1 * 2/2001 Mishima ..... 428/32.34
6,303,212 B1 * 10/2001 Shaw-Klein et al. ..... 428/32.3
6,492,005 B1 * 12/2002 Ohbayashi et al. ..... 428/32.29
6,777,039 B2 * 8/2004 Koike et al. ..... 428/32.26
2003/0219551 A1 11/2003 Burch et al.
2004/0033377 A1 * 2/2004 Koenig ..... 428/458

FOREIGN PATENT DOCUMENTS

| | | | |
|---|---|---|---|
| EP | 1 407 891 | A | 4/2004 |
| GB | 2 369 075 | A | 5/2002 |
| JP | 2000-239578 | A | 9/2000 |
| JP | 2002-225427 | A | 8/2002 |
| WO | WO 99/29513 | A | 6/1999 |
| WO | WO 01/05599 | A | 1/2001 |
| WO | WO 01/81078 | A | 11/2001 |
| WO | WO 2005/118303 | A | 12/2005 |
| WO | WO 2005/118306 | A | 12/2005 |

* cited by examiner

*Primary Examiner*—Betelhem Shewareged

(57) ABSTRACT

The present invention is drawn to a media sheet for ink-jet printing and can comprise a media substrate and a coating composition applied to the media substrate to form an ink-receiving layer. The ink-receiving layer can include semi-metal oxide or metal oxide particulates, at least 5 wt % of a water soluble coating formulation additive, and a binder. The media sheet can also have a wash conductivity less than about 80 microsiemens/cm, said wash conductivity determined by measuring the conductivity of a 50 mL bath of deionized water after placing a 100 $cm^2$ sample of the media sheet in the deionized water for 45 seconds at room temperature under agitation.

18 Claims, No Drawings

INK-JET RECORDING MEDIUM FOR DYE- OR PIGMENT-BASED INK-JET INKS

The present application is continuation-in-part application of U.S. patent application Ser. No. 11/110,106, filed on Apr. 19, 2005, which is a continuation-in-part application of U.S. patent application Ser. No. 10/854,350, filed on May 26, 2004, both of which are incorporated herein by reference.

FIELD OF THE INVENTION

The present invention relates generally to ink-jet printing. More particularly, the present invention relates to ink-jet print media including semi-metal or metal oxide-based media coatings.

BACKGROUND OF THE INVENTION

Ink-jet inks typically comprise an ink vehicle and a colorant, the latter of which may be a dye or a pigment. Dye-based ink-jet inks used in photographic image printing are almost always water-soluble dyes. As a result, such dye-based ink-jet inks are usually not very water fast, i.e. images tend to shift in hue and edge sharpness is reduced upon exposure to humid conditions, especially when printed on media substrates having a porous ink-receiving layer. In addition, images created from these water-soluble dye-based ink-jet inks tend to fade over time, such as when exposed to ambient light and/or air. Pigment-based inks on the other hand, allow the creation of images that are vastly improved in humid fastness and image fade resistance. Pigment based images, however, are inferior to dye-based ink-jet inks with respect to the desirable trait of gloss uniformity.

Print media surfaces play a key role in fade properties, humid fastness, and the quality of ink-jet produced printed images. Thus, for a given ink, the degree of air fade, humid fastness, and image quality can be dependent on the chemistry of the media surface. As a result, many ink-jet inks can be made to perform better when an appropriate media surface is used. For example, pigment based ink can be very sensitive to media coating compositions. Images printed with pigment based ink on porous media usually exhibit haze, lower gloss, or even completely lose gloss (also referred as degloss) at high ink density. There are also problems of air fade and humid fastness associated with dye-based ink-jet inks as well. The ability for a printed imaged to be handled and exhibit scratch resistance can also be poor if the media is not compatible with ink-jet inks, particularly pigment-based ink-jet inks.

As such, it would be an advancement in the art to provide images that exhibit high gloss and high gloss uniformity with both dye and pigment based ink. Without this degloss phenomena, the gloss uniformity can appear significantly higher. Also because of tight packing of pigment colorants in pigment-based ink-jet inks, the scratch resistance of the printed image can be significantly improved. Further, color gamut, black density, and humid fastness for dye-based ink-jet inks can also be significantly improved.

SUMMARY OF THE INVENTION

In accordance with embodiments of the present invention, print media has been prepared that does not substantially interact unfavorably with dye-based or pigment-based ink-jet inks.

In accordance with this, a media sheet for ink-jet printing can comprise a media substrate and a coating composition applied to the media substrate to form an ink-receiving layer. The ink-receiving layer can include semi-metal oxide or metal oxide particulates, binder, and at least 5 wt % of a water-soluble coating formulation additive associated with the particulates or with the binder. Even with the presence of the water soluble coating formulation additive, the media sheet has a wash conductivity less than about 80 microsiemens/cm, which is determined by measuring the conductivity of a 50 mL bath of deionized water after placing a 100 $cm^2$ sample of the media sheet in the deionized water for 45 seconds at room temperature under agitation.

Additional features and advantages of the invention will be apparent from the following detailed description which illustrates, by way of example, features of the invention.

DETAILED DESCRIPTION OF THE PREFERRED EMBODIMENT(S)

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a dye" includes reference to one or more of such materials.

"Image permanence" refers to characteristics of an ink-jet printed image that relate to the ability of the image to last over a period of time. Characteristics of image permanence include image fade resistance, water fastness, humid fastness, light fastness, smudge resistance, air pollution induced fading resistance, scratch and rub resistance, etc.

"Media substrate" or "substrate" includes any substrate that can be coated for use in the ink-jet printing arts including papers, overhead projector plastics, coated papers, fabric, art papers, e.g., water color paper, and the like.

"Porous media coating" typically includes inorganic particulates, such as silica or alumina particulates, bound together by a polymeric binder. Optionally, mordants and/or other additives can also be present. Such additives can be water soluble coating formulation additives including multivalent salts, such as aluminum chlorohydrate and/or acidic components, such as acidic crosslinking agents. An example of an acidic crosslinking agent that can be used to crosslink a polymeric binder, such as polyvinyl alcohol, is boric acid. The composition can be used as a coating for various media substrates, and can be applied by any of a number of methods known in the art. Additionally, such compositions can be applied in single layer or in multiple layers. If multiple layers are applied, then these multiple layers can be of the same or similar composition, or can be of different compositions.

The term "water soluble coating formulation additive" refers to ionic and other compositions that are added to coating compositions for preparative, coating, or performance enhancing purposes. Though useful for these purposes, unreacted or excess amounts of such materials that may remain at resulting ink-receiving layers are undesirable with respect to print quality. For example, water soluble coating formulation additives tend to coalesce or coagulate colorants of ink-jet inks upon printing, as well diminish image gloss. Examples of water soluble coating formulation additives include unreacted acidic crosslinking agents and other acids, and/or salts such as multivalent or high valent salts. The removal of excess or unbound forms of these materials from an ink-receiving layer can improve color gamut of printed images, and particularly, the removal of excess salts can improve humid fastness. Organosilane reagents that are covalently attached to semi-metal or metal oxide particulates, making no contribution to the conductivity of the coating mix, are not considered to be water soluble coating formulation additives in accordance with embodiments of the present invention.

"Aluminum chlorohydrate," "ACH," "polyaluminum chloride," "PAC," "polyaluminum hydroxychloride," or the like, refers to a class of soluble aluminum products in which aluminum chloride has been partly reacted with a base. The relative amount of OH compared to the amount of Al can determine the basicity of a particular product. The chemistry of ACH is often expressed in the form $Al_n(OH)_mCl_{(3n-m)}$, wherein n can be from 1 to 50, and m can be from 1 to 150. Basicity can be defined by the term m/(3n) in that equation. ACH can be prepared by reacting hydrated alumina $AlCl_3$ with aluminum powder in a controlled condition. The exact composition depends upon the amount of aluminum powder used and the reaction conditions. Typically, the reaction can be carried out to give a product with a basicity of 40% to 83%. ACH can be supplied as a solution, but can also be supplied as a solid.

There are other ways of referring to ACH, which are known in the art. Typically, ACH comprises many different molecular sizes and configurations in a single mixture. An exemplary stable ionic species in ACH can have the formula $[Al_{12}(OH)_{24}AlO_4(H_2O)_{12}]^{7+}$. Other examples include $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc. Other common names used to describe ACH or components that can be present in an ACH composition include Aluminum chloride hydroxide (8Cl); A 296; ACH 325; ACH 331; ACH 7-321; Aloxicoll; Aloxicoll LR; Aluminium hydroxychloride; Aluminol ACH; Aluminum chlorhydrate; Aluminum chlorohydroxide; Aluminum chloride hydroxide oxide, basic; Aluminum chloride oxide; Aluminum chlorohydrate; Aluminum chlorohydrol; Aluminum chlorohydroxide; Aluminum hydroxide chloride; Aluminum hydroxychloride; Aluminum oxychloride; Aquarhone; Aquarhone 18; Astringen; Astringen 10; Banoltan White; Basic aluminum chloride; Basic aluminum chloride, hydrate; Berukotan AC-P; Cartafix LA; Cawood 5025; Chlorhydrol; Chlorhydrol Micro-Dry; Chlorhydrol Micro-Dry SUF; E 200; E 200 (coagulant); Ekoflock 90; Ekoflock 91; GenPac 4370; Gilufloc 83; Hessidrex WT; HPB 5025; Hydral; Hydrofugal; Hyper Ion 1026; Hyperdrol; Kempac 10; Kempac 20; Kemwater PAX 14; Locron; Locron P; Locron S; Nalco 8676; OCAL; Oulupac 180; PAC; PAC (salt); PAC 100W; PAC 250A; PAC 250AD; PAC 300M; PAC 70; Paho 2S; PALC; PAX; PAX 11S; PAX 16; PAX 18; PAX 19; PAX 60p; PAX-XL 1; PAX-XL 19; PAX-XL 60S; PAX-XL 61S; PAX-XL 69; PAX-XL 9; Phacsize; Phosphonorm; (14) Poly(aluminum hydroxy) chloride; Polyaluminum chloride; Prodefloc AC 190; Prodefloc AL; Prodefloc SAB 18; Prodefloc SAB 18/5; Prodefloc SAB 19; Purachem WT; Reach 101; Reach 301; Reach 501; Sulzfloc JG; Sulzfloc JG 15; Sulzfloc JG 19; Sulzfloc JG 30; TAI-PAC; Taipac; Takibine; Takibine 3000; Tanwhite; TR 50; TR 50 (inorganic compound); UPAX 20; Vikram PAC-AC 100S, WAC; WAC 2; Westchlor 200; Wickenol 303; Wickenol CPS 325 Aluminum chlorohydrate $Al_2ClH_5O_5$ or $Al_2(OH)_5Cl\ 2H_2O$ or $[Al(OH)_2Cl]_x$ or $Al_6(OH)_{15}Cl_3$; $Al_2(OH)_5Cl]_x$ Aluminum chlorohydroxide; Aluminum hydroxychloride; Aluminum chloride, basic; Aluminum chloride hydroxide; $[Al_2(OH)_nCl_{6-n}]_m$; $[Al(OH)_3]_nAlCl_3$; or $Al_n(OH)_mCl_{(3n-m)}$ (where generally, $0<m<3n$); for example. In one embodiment, preferred compositions include aluminum chlorides and aluminum nitrates of the formula $Al(OH)_2X$ to $Al_3(OH)_8X$, where X is Cl or $NO_3$. In another embodiment, preferred compositions can be prepared by contacting silica particles with an aluminum chlorohydrate ($Al_2(OH)_5Cl$ or $Al_2(OH)Cl_5.nH_2O$). It is believed that contacting a silica particle with an aluminum compound as described above causes the aluminum compound to become associated with or bind to the surface of the silica particles. This can be either by covalent association or through an electrostatic interaction to form a cationic charged silica, which can be measured by a Zeta potential instrument.

"Organosilane reagent" includes compositions that comprise a functional or active moiety which is covalently attached to a silane grouping. In one optional embodiment, the semi-metal or metal oxide particulates, such as silica or alumina, can be surface-modified with such organosilane reagents. Examples of moieties that can provide a desirable function include anionic dye anchoring groups (such as amines, quaternary ammonium salts, etc.), ultraviolet absorbers, metal chelators, hindered amine light stabilizers, reducing agents, hydrophobic groups, ionic groups, buffering groups, or functionalities for subsequent reactions. The functional moiety portion of the organosilane reagent can be directly attached to the silane grouping, or can be appropriately spaced from the silane grouping, such as by from 1 to 10 carbon atoms or other known spacer groupings. The silane grouping of the organosilane reagent can be attached to inorganic particulates of the porous media coating composition through hydroxyl groups, halo groups, or alkoxy groups present on the reagent. Alternatively, in some instances, the organosilane reagent can be merely attracted to the surface of the inorganic particulates. Organosilane reagents that are covalently attached to semi-metal or metal oxide particulates, making no contribution to the conductivity of the coating mix, are not considered to be water soluble coating formulation additives in accordance with embodiments of the present invention.

The term "ink-receiving layer(s)" refers to a layer or multiple layers that are coated on a media substrate, which are configured to receive ink upon printing. As such, the ink-receiving layer(s) do not necessarily have to be the outermost layer, but can be layer that is beneath another coating.

The term "wash conductivity" refers to a measure of wash effluent's ability to conduct electrical current. This current is a direct measure of water soluble salts or electrolytes in the effluent.

The term "about" when referring to a numerical value or range is intended to encompass the values resulting from experimental error that can occur when taking measurements.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

Images produced using either pigment-based ink-jet inks or dye-based ink-jet inks can be affected by the print media to which the ink is applied. In particular, pigment-based inks, which sometimes contain latex particulates and/or binders, can be very sensitive to undesired material that are often present in ink-receiving layers of print media. For example, water soluble coating formulation additives, such as acids, multivalent ions, or aluminum chlorohydrate, can be desired for the manufacture certain media coatings. However, these materials in excess, after the coating composition has dried to form an ink-receiving layer, can have undesired an affect on the ink-jet ink. Further, these and other similar materials, when added, can generate unwanted electrolytes or salts. For example, a coating composition prepared that includes semi-metal oxide or metal oxide particulates, polyvinyl alcohol, sodium borate, NaOH, and aluminum chlorohydrate results in unwanted NaCl salts. These and other ionic compositions can cause the dyes to bleed at humid condition. In some cases, scratch resistance can become poor due to pigment interaction with such media surfaces. Additionally, unreacted boric acid, which is often used as a crosslinking agent to increase the binding strength of polyvinyl alcohol binder in semi-metal or metal oxide-based media coatings, can cause pigment coagulation, resulting in a reduction or loss in gloss. Alternatively, with dye-based ink-jet inks, unreacted or excess water soluble coating formulation additives can reduce color chroma and black density, as well as reduce image gloss.

In accordance with this recognized problem, the present invention is drawn to specialty ink-jet media, wherein generated, excess, or unreacted amounts of these ionic and/or other interfering water soluble components are at least partially removed to produce improved compatibility with ink-jet ink components, such as dyes and/or pigments. Printed images on such media have shown uniform and high gloss, as well as improved scratch resistance with pigment-based ink-jet inks. The substantial absence of such generated, excess, or unreacted amounts of these ionic and/or other interfering water soluble components can be verified by conducting a simple wash conductivity test.

This being stated, a media sheet for ink-jet printing can comprise a media substrate and a coating composition applied to the media substrate to form an ink-receiving layer. The ink-receiving layer can include semi-metal oxide or metal oxide particulates, binder, and at least 5 wt % of a water soluble coating formulation additive associated with the particulates or the binder. Even with the presence of the water soluble coating formulation additive, the media sheet has a wash conductivity less than about 80 microsiemens/cm, which is determined by measuring the conductivity of a 50 mL bath of deionized water after placing a 100 $cm^2$ sample of the media sheet in the deionized water for 45 seconds at room temperature.

In another embodiment, a method of preparing a media sheet for ink-jet printing can comprise multiple steps. One step includes preparing a coating composition including metal or semi-metal oxide particulates, binder, and at least one water soluble coating formulation additive, wherein at least a portion of the water soluble coating formulation additive i) is in the form of unreacted additive, or ii) generates undesired electrolytes. Additional steps include applying the coating composition to a media substrate to form an ink-receiving layer, and removing at least a portion of the unreacted additive or undesired electrolytes either before or after applying the coating composition. In this embodiment, the ink-receiving layer can include at least 5 wt % of the water soluble coating formulation additive after the unreacted additive or undesired electrolytes are removed. Further, at least a portion of the water soluble coating formulation additive in the ink-receiving layer can be associated with the metal or semi-metal oxide particulates or the binder. Again, media sheet as a whole can have a wash conductivity less than about 80 microsiemens/cm, which is determined by measuring the conductivity of a 50 mL bath of deionized water after placing a 100 $cm^2$ sample of the media sheet in the deionized water for 45 seconds at room temperature under agitation.

In both of these embodiments, even in the presence of such a relatively large amount of the water-soluble coating formulation additive, i.e. at least 5 wt % within the ink-receiving layer, the wash conductivity is quite low. This is because most of the water-soluble coating formulation additive is believed to be bound to the particulates and/or binder, and a large portion of unbound additive is removed. In other words, by removing a large portion of undesired excess/unbound additive from the ink receiving layer (either before or after application), the benefits of leaving a relatively large amount of particulate- or binder-bound additive present in the ink-receiving layer can provide positive print results, and the detriments associated with the presence of excess/unbound additive can be minimized. In ink-receiving layers having at least 5 wt % of the water-soluble coating formulation additive present, this state of minimal excess/unbound additive can be evidenced by the low wash conductivity in accordance with embodiments of the present invention.

Various methods can be used to prepare coated media substrates that do not interact unfavorably with dye-based or pigment-based ink-jet inks, and which pass the aforementioned wash conductivity test. In some of the embodiments described herein, a water soluble coating formulation additive is typically included in a coating composition for improving at least one of a coating preparation property, a coating application property, or a media performance property. However, unreacted additive(s) or additive(s) that generate undesired electrolytes or salts can create printing difficulties, as previously set forth. There are at least two basic strategies of removing unreacted additive(s) or generated electrolytes or salts, including removing the additive(s)/generated electrolytes prior to application of a coating composition, or after application of a coating composition, i.e. after forming the ink-receiving layer.

In an exemplary embodiment involving removal of excess additive(s) or generated electrolytes prior the application of a coating composition, a media coating can be prepared that exhibits improved lightfastness, scratch resistance, and image quality. Such a coating can include a porous pigment, such as fumed silica (about 50 wt % to 75 wt %), as a primary structural particulate component; a multivalent salt, such as aluminum chlorohydrate (about 5 wt % to 8 wt %), which provides a cationic surface charge to the system; and a binder, such as polyvinyl alcohol (about 15 wt % to 20 wt %) to bind the silica and the aluminum chlorohydrate together. To increase the binding power of the polyvinyl alcohol, a crosslinking agent, such as boric acid (about 0.5 wt % to 5 wt %) can be added. The coating mix can be refined by removing excess amounts of the aluminum chlorohydrate by ultrafiltration, for example. Ultrafiltration can be carried out using a porous membrane having an average pore size of about 50 nm. Back pressure of about 100 psi can be applied to the composition, and small substances, including undesired electrolytes and/or unreacted additive, will pass through the pores along with the water. As such material is passed through the pores, deionized water can be used to replenish the lost water, thereby refining the coating composition. The coating mix in a more refined state can then be applied on a non-absorbing base or substrate, and subsequently dried. The coat weight can be controlled at from 25 g/m$^2$ to 35 g/m$^2$. In one embodiment, a second coating including more spherical colloidal silica (40 nm to 100 nm) can be applied as an overcoat to provide a glossy and scratch resistant finish. If the second coating is not formulated with ionic compositions or acid, for example, a refining or removing step is not necessary, though such a step is not precluded.

In another exemplary embodiment, removal of unwanted additive(s) or generated electrolyte(s) after application of a coating composition to a media substrate can be conducted to produce print media that exhibits improved lightfastness, scratch resistance, and image quality. Such a coating can include a porous pigment, such as fumed silica (about 50 wt % to 75 wt %), as a primary structural particulate component; a multivalent salt, such as aluminum chlorohydrate (about 5 wt % to 8 wt %), which provides a cationic surface charge to the system; and a binder, such as polyvinyl alcohol (about 15 wt % to 20 wt %) to bind the silica and the aluminum chlorohydrate together. To increase the binding power of the polyvinyl alcohol, a crosslinking agent, such as boric acid (about 0.5 wt % to 5 wt %) can be added. The coating mix can be applied on a non-absorbing base or substrate, and subsequently dried. The coat weight can be controlled at from 25 g/m$^2$ to 35 g/m$^2$. In one embodiment, a second coating including more spherical colloidal silica (40 nm to 100 nm) can be applied as an overcoat to provide a glossy and scratch resistant finish. The coated paper can then be passed through a water bath or water spray, causing the free acid and free high valent ions in the coating to be substantially removed.

In another exemplary embodiment, a media coating can be prepared that exhibits improved lightfastness, scratch resistance, and image quality. Such a coating can include a porous pigment, such as fumed silica (about 50 wt % to 75 wt %), as a primary structural particulate component; a multivalent salt, such as aluminum chlorohydrate (about 5 wt % to 8 wt %), which provides a cationic surface charge to the system; and a binder, such as polyvinyl alcohol (about 15 wt % to 20 wt %) to bind the silica and the aluminum chlorohydrate together. To increase the binding power of the polyvinyl alcohol, a crosslinking agent, such as boric acid (about 0.5 wt % to 5 wt %) can be added. The coating mix can be applied on a non-absorbing base or substrate, and subsequently dried. The coat weight can be controlled at from 25 g/m$^2$ to 35 g/m$^2$. The coated paper can then be passed through a water bath or water spray, causing the free acid and free high valent ions in the coating to be substantially removed. In one embodiment, a second coating including more spherical colloidal silica (40 nm to 100 nm) can be applied as an overcoat to provide a glossy and scratch resistant finish. If the second coating is not formulated with ionic compositions or acid, for example, a washing step is not necessary, though such a step is not precluded.

Regarding the washing step itself, this step can be conducted by bath, spraying, or by other known washing techniques. Typically, the water can be at about room temperature, though temperatures from about 0° C. to 90° C. can used. In one embodiment, hot water from 30° C. to 50° C. can be used. The water used can be deionized water, hard water, soft water, or water with additives. For example, the water can include a buffer (0.1 to 1% solids) to control the pH during the washing stage at from pH 5 to 7.5. Whatever water type (with or without additives) is used, the washing step can be used to contribute to the final pH of the media sheet. In one embodiment, the pH of an ink-receiving layer of the media sheet can be from about pH 4 to about pH 7.5. In another embodiment, the pH of the ink-receiving layer can be from about pH 5 to about pH 6. Other additives that can be present in the water include additives that contribute to print quality, such as air fade additives or the like. Examples of air fade additives that can be included are radical scavengers, hindered amines, and/or thio compounds such as thiodiethylene glycol.

With respect to the semi-metal or metal oxide particulates that can be used in various embodiments of the present invention, such particulates that can be selected for use include silica, alumina, titania, zirconia, aluminum silicate, calcium carbonate, and/or other naturally occurring pigments. These compositions can be in various forms and in various shapes, for example, silica can be fumed silica, colloidal silica, precipitated silica, or grounded silica gel, depending on the affect that is desired to achieve. For example, 30 nm to 100 nm spherical silica particulates can be used to provide a glossy appearance, whereas larger less spherical particulates may provide a less glossy appearance. More irregular shapes, on the other hand, may provide more voids between particles than may be present with tightly packed spherical particulates.

As the semi-metal or metal oxide particulates are not self-adherent, typically, a binder is added to the composition to bind the particulates together. An amount of binder is typically added that provides a balance between binding strength and maintaining particulate surface voids and inter-particle spaces for allowing ink to be received. Exemplary binders that can be used include polyvinyl alcohol, both fully hydrolyzed and partially hydrolyzed, such as Airvol supplied by Air Product or Mowiol supplied by Clariant; modified polyvinyl alcohol, such as acetoacetylated polyvinyl alcohols commercially available as the GOHSEFIMER Z series from Nippon Gohsei; amine modified polyvinyl alcohol; and polyvinyl alcohol modified by silane coupling agent. Other binders that can be used include polyester, polyester-melanine, styrene-acrylic acid copolymers, styrene-acrylic acid-alkyl acrylate copolymers, styrene-maleic acid copolymers, styrene-maleic acid-alkyl acrylate copolymers, styrene-methacrylic acid copolymers, styrene-methacrylic acid-alkyl acrylate copolymers, styrene-maleic half ester copolymers, vinyl naphthalene-acrylic acid copolymers, vinyl naphthalene-maleic acid copolymers, and salts thereof. In some embodiments, it can be more desirable to use polyvinyl alcohol and/or modified polyvinyl alcohol as the interaction between the binder and silica is very strong, resulting in a formed coating that is substantially water insoluble. To improve the binding strength of the binder, a crosslinking agent, such as boric acid, can be added to the coating composition. When a crosslinking agent is used, less binder may be required for use. Other crosslinking agents that can be used include borate salt, titanium salt, vanadium and chromium salts, melamine formaldehyde, glyoxal, thiourea formaldehyde, and Curesan. Though a purpose of the invention is to remove unreacted water soluble coating formulation additives, this does not mean that only water soluble coating formulation additive must be used, as other formulation additives that do not interfere with print quality can also be used therewith.

In accordance with the above embodiments, aluminum chlorohydrate or another multivalent salt can be added to aid in the coating composition as well. Exemplary salts that can be added to coating compositions to provide benefit to the coating composition, but which should be removed from the ink-receiving layer if excess amounts are present, include aluminum chlorohydrate, and trivalent or tetravalent metal oxides with metals such as aluminum, chromium, gallium, titanium, and zirconium. If, for example, aluminum chlorohydrate is used, it can be present in the coating composition at from 2 wt % to 20 wt % compared to the silica content, and in a more detailed embodiment, the aluminum chlorohydrate can be present at from 5 wt % to 10 wt %.

The ink-receiving layer can alternatively or additionally include one or more acid(s), such as boric acid. By adding boric acid, a crosslinking reaction can be carried out with the binder which provides for improved binding strength. Improved binding strength can lead to reduced cracking at the ink-receiving layer.

In practice, adding a multivalent salt, such as aluminum chloride hydrate, can provide stability to the coating mix prior to application, and reduces the tendency for the receiving layer to be low in gloss. Additionally, boric acid can be added to improve the binding power of the coating composition, thereby reducing the tendency of a dried receiving layer to crack. As described, though the aluminum chlorohydrate and the boric acid provide these benefits, they also have the negative affect of causing ink-jet inks under perform. For example, pigment-based inks, in the presence of boric acid and aluminum chlorohydrate on a media substrate, have a tendency to lose their gloss at a higher ink load. Thus gloss uniformity will suffer. In other words, unreacted high valent salt and acid can work to undesirably coagulate ink. When dye- or pigment-based inks coagulate, color gamut suffers and image scratch resistance will deteriorate. By conducting a washing step to substantially remove excess acid and excess high valent salts, image quality can be greatly improved.

In addition to the salt and/or acid groups that can be added, the semi-metal or metal oxide particulates can also be modified with organic groups. Specifically, organosilane reagents can be added to the surface-activated silica to add additional positively charged moieties to the surface, or to provide another desired function at or near the surface, e.g., ultraviolet absorber, chelating agent, hindered amine light stabilizer, reducing agent, hydrophobic group, ionic group, buffering group, or functionality for a subsequent reaction. As these reagents are primarily organic, they can provide different properties with respect to ink-jet ink receiving properties. However, as these materials are typically covalently attached to the surface of the semi-metal or metal oxide particulates, they do not create the same kind of printing issues as free salts and free acids.

In one embodiment, the organosilane reagents can be amine-containing silanes. In a more detailed embodiment, the amine-containing silanes can include quaternary ammonium salts. Examples of amine-containing silanes include 3-aminopropyltrimethoxysilane, N-(2-aminoethyl-3-aminopropyltrimethoxysilane, 3-(triethoxysilylpropyl)-diethylenetriamine, poly(ethyleneimine)trimethoxysilane, aminoethylaminopropyl trimethoxysilane, aminoethylaminoethylaminopropyl trimethoxysilane, and the quaternary ammonium salts of the amine coupling agents mentioned above. An example of a quaternary ammonium salt organosilane reagent includes trimethoxysilylpropyl-N,N,N-trimethylammonium chloride.

Alternatively, other organosilane coupling agents can be useful for the modification of a silica surface, including bis(2-hydroethyl)-3-aminopropyltriethoxysilane, 3-mercaptopropyltrimethoxysilane, 3-glycidoxypropyltrimethoxysilane, bis(triethoxysilylpropyl)disulfide, 3-aminopropyltriethoxysilane, 3-aminopropylsilsesquioxane, bis-(trimethoxysilylpropyl)amine, N-phenyl-3-aminopropyltrimethoxysilane, N-aminoethyl-3-aminopropylmethyldimethoxysilane, 3-ureidopropyltrimethoxysilane, 3-methacryloxypropyltrimethoxysilane, N-(trimethyloxysilylpropyl)isothiouronium chloride, N-(triethoxysilpropyl)-O-polyethylene oxide,3-(triethoxylsilyl)propylsuccinic anhydride, 3-(2-imidazolin-1-yl)propyltriethoxysilane, and reagents sold under the trade name SILQUEST (OSI Products), SiventoSilane (Degussa), Dynasylan, and/or Cab-O-Sil M-5 (Cabot Corp.).

Other organosilane reagents can also be used that provide a benefit to a printing system, such as reagents that include an active ligand or moiety. Examples of such active ligands or moieties include those that act as an ultraviolet absorber, chelating agent, hindered amine light stabilizer, reducing agent, hydrophobic group, ionic group, buffering group, or functionality for a subsequent reaction. To illustrate this, Formula 1 provides examples of organosilane reagents that can accordingly be used:

Formula 1

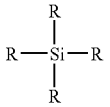

In Formula 1 above, from 0 to 2 of the R groups can be H, —$CH_3$, —$CH_2CH_3$, or —$CH_2CH_2CH_3$; from 1 to 3 of the R groups can be halo or alkoxy; and from 1 to 3 of the R groups can be an active or functional moiety, such as one described previously. If halo is present, then Formula 1 can be said to be an organohalosilane reagent. If alkoxy is present, then Formula 1 can be said to be an organoalkoxysilane reagent.

An inclusive list of functional moieties that can be attached to the metal or semi-metal oxide surface includes straight or branched alkyl having from 1 to 22 carbon atoms, cyano, amino, halogen substituted amino, carboxy, halogen substituted carboxy, sulfonate, halogen substituted sulfonate, halogen, epoxy, furfuryl, mercapto, hydroxyl, pyridyl, imidazoline derivative-substituted lower alkyl, lower cycloalkyl, lower alkyl derivatives of cycloalkyl, lower cycloalkenyl, lower alkyl derivatives of cycloalkenyl, lower epoxycycloalkyl, lower alkyl derivatives of epoxycycloalkyl, phenyl, alkyl derivatized phenyl, phenoxy, poly(ethylene oxides), poly(propylene oxide), copolymer of polyethyleneoxide and poly(propyleneoxide), vinyl, benzylic halogen, alkyl derivatized phenoxy, quaternary amine, monoethyleneimine, or polyethyleneimine.

The media substrate that can be used can be of any substrate known in the art, and can include papers, overhead projector plastics, coated papers, fabric, art papers, e.g., water color paper, photobase, or the like. The application of the porous coating composition to a media substrate can be by any method known in the art, such as air knife coating, blade coating, gate roll coating, doctor blade coating, Meyer rod coating, roller coating, reverse roller coating, gravure coating, brush coating, sprayer coating, or cascade coating.

Ink-jet ink compositions that can be used to print on the coated media compositions of the present invention are typically prepared in an aqueous formulation or liquid vehicle which can include water, cosolvents, surfactants, buffering agents, biocides, sequestering agents, viscosity modifiers, humectants, binders, and/or other known additives. Colorants, such as dyes and/or pigments are also present to provide color to the ink-jet ink. In one aspect of the present invention, the liquid vehicle can comprise from about 70 wt % to about 99.9 wt % of the ink-jet ink composition. In another aspect, other than the colorant, liquid vehicle can also carry polymeric binders, latex particulates, and/or other solids.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what are presently deemed to be the most practical and preferred embodiments of the invention.

Example 1

Preparation of ACH-Treated Silica

To 375 ml of water were added 11 mL of 2N NaOH and 27.9 grams of 50% aluminum chlorohydrate (ACH) under strong agitation. Then, 86.1 grams of fumed silica Cab-o-sil M-5 was added into the dispersion. The product was aged for about 24 hours producing a cationic silica sol having 20 wt % solids. In this embodiment, the aluminum chlorohydrate was used as a dispersing agent which converted the silica surface from anionic to cationic, providing a repulsion force with respect to the silica pigments, thereby preventing the sol from flocculating and providing acceptable stability.

Example 2

Preparation of Base Coating Composition

In a first container, ACH-treated silica prepared in accordance with Example 1 was mixed with boric acid. In a second container, polyvinyl alcohol, thiodiethyleneglycol and Olin-10G surfactant were mixed together. The contents of the two containers were admixed together. The relative amount of each of the ingredients is set forth in Table 1 below, with the balance being water.

TABLE 1

| Base coating (Composition 1) | wt % |
|---|---|
| Example 1 ACH-treated silica | 12.4 solids |
| Boric acid | 0.41 solids |
| Thiodiethyleneglycol | 0.27 solids |
| Polyvinyl alcohol (MO2688) | 3.18 solids |
| Water | balance |

Example 3

Preparation of Media Substrate Having Base Coating Composition Coated Thereon The base coating of Example 2 (Composition 1) was coated on two separate sheets of photobase paper, each coating being applied at 28 g/m$^2$ (referred to as Sample 1A and Control Sample 1B). When the samples were dry, Sample 1A was soaked in a 100 ml bath of water for 3 minutes and re-dried. Table 2 below describes the dry g/m$^2$ of each compositional component of Sample 1A after preparation in accordance with the present example.

TABLE 2

| Base coating layer of Sample 1A after washing | g/m$^2$ (dry) |
|---|---|
| Cab-M5(4.5 M % ACH, KOH) | 21 |
| Boric acid | 0.699 |
| Thiodiethyleneglycol | 0.462 |
| PVOH MO2688 | 5.39 |
| Wet coat weight (gm/m$^2$) | 169.5 |

Control Sample 1B was prepared similarly, but was not soaked and re-dried, i.e. no washing step.

Example 4

Preparation of a Top Coating Composition

A top coating composition was prepared by admixing boric acid, glycerine, and Cartacoat K303 C. The amount of each composition is set forth in Table 3 below.

TABLE 3

| Top coating (Composition 2) | wt % |
|---|---|
| Boric acid | 0.48 solids |
| Glycerine | 2.89 solids |
| Cartacoat K303 C | 1.92 solids |
| Water | balance |

Example 5

Preparation of Media Substrate Having Base Coating Composition and Top Coating Composition Coated Thereon The base coating of Example 2 (Composition 1) and the top coating of Example 4 (Composition 2) were applied in quick succession using a curtain or cascade coating method. The bottom coating layer of Example 2 was applied at a coat weight of 27 g/m$^2$, and the top coating layer of Example 4 utilized spherical colloidal silica and was applied at a coat weight of 0.2 g/m$^2$. Two sheets of coated samples were labeled as Sample 2A and Control Sample 2B). Sample 2A and 2B were both dried. Sample 2A was then passed through a water bath and re-dried. The resident time of Sample 2A in the water bath was adjusted to be about 30 to 50 seconds, with the water being continually agitated. Table 4 below describes the dry g/m$^2$ of each compositional component of the top coating layer of Sample 2A after preparation in accordance with the present example.

TABLE 4

| Top coating layer of Sample 2A after washing | g/m$^2$ (dry) |
|---|---|
| Boric acid | 0.05 |
| Glycerine | 0.3 |
| Cartacoat K303 C | 0.2 |
| Anti blocking 4GZ | 0.02 |
| Wet coat weight (gm/m$^2$) | 10.4 |

Control Sample 2B was prepared similarly, but was not soaked and re-dried, i.e. no washing step after application of the top coating.

Example 6

Preparation of Alternative Top Coating Composition

An alternative top coating composition was prepared by admixing Olin 10G, glycerine, Cartacoat K303 C, and polyvinyl alcohol (MO2566). This top coating composition was devoid of any water soluble coating formulation additive. The amount of each composition is set forth in Table 5 below.

TABLE 5

| Top coating (Composition 3) | wt % |
|---|---|
| Olin 10G | 0.12 solids |
| Glycerine | 1.54 solids |
| Cartacoat K303 | 1.54 solids |
| Polyvinyl alcohol (MO2566) | 0.154 solids |
| Water | balance |

Example 7

Preparation of Media Substrate Having Base Coating Composition and Alternative Top Coating Composition Coated Thereon A media sheet was prepared in accordance with Example 3 (Sample 1A) having at least a portion of water soluble electrolytes and other ionic components washed therefrom. The coated media was then passed through a doctor roll to remove the surface water. The top coating of Example 6 (Composition 3) was coated on top of the washed Sample 1A media sheet. The coat weight of the top coating composition was applied to Sample 1A at a coating weight of about 0.2 g/m$^2$. As apparent from Table 5, the top coating composition was formulated such that it was devoid of boric acid and electrolytes. The media sheet was then re-dried and labeled as Sample 3A. Table 6 below describes the dry g/m$^2$ of each compositional component of the top coating layer of Sample 3A after preparation in accordance with the present example.

TABLE 6

| Top coating layer of Sample 3A after washing | g/m$^2$ (dry) |
|---|---|
| Olin 10G | 0.015 |
| Glycerine | 0.2 |
| Cartacoat K303 | 0.2 |
| Polyvinyl alcohol (MO2566) | 0.02 |
| Wet coat weight (gm/m$^2$) | 13.0 |

Control Sample 3B was prepared by using Control Sample 1B (base coating Composition 1 applied to photobase without washing step), which was directly coated with the top coating composition of the Example 6 (top coating Composition 3). The top layer composition coat weight was also 0.2 g/m$^2$.

Example 8

Print Results

Various tests were conducted comparing Samples 1A, 2A, and 3A to Control Samples 1B, 2B, and 3B, respectively. Each of the "A" samples were washed in accordance with embodiments of the present invention, and the "B" control samples lacked a desired washing step. For each media sample, tests were conducted that compared a) pigment gloss uniformity; b) dye gamut; c) humid bleed; d) media brittleness; and e) ink capacity.

a) Pigment Gloss Uniformity

Two color ramp types were printed on each media sample (1A, 1B, 2A, 2B, 3A, and 3B). Specifically, several Type I (primary and black) color ramps (cyan, gray, light cyan, light magenta, magenta, yellow, and black) were printed with increasing density in 16 steps on each media sample from 20 ng/pixel to 320 ng/pixel, with a 20 ng/pixel density difference from one density to the next, e.g., 20, 40, 60, . . . 300, 320. Additionally, several Type II (secondary) color ramps (blue, cyan, green, magenta, orange, red, and yellow) were obtained by printing either one color alone or two colors together at from 20 ng/pix to 320 ng/pixel in 16 steps (as described with respect to Type I color ramps), and then black ink was gradually mixed therein causing the color to transition to black over another 16 steps (total of 16 steps for Type I and 32 steps for Type II). Each pixel was sized at 1/300 of an inch.

Gloss was determined based on a 0 to 100 scale, where 0 is no gloss and 100 is maximum gloss. Each of the 16 densities for the Type I color ramp and the 32 densities for Type II color ramp on each of their respective 7 colors was measured on multiple media types. Table 7 depicts an average gloss comparison for Sample 2A and 2B.

TABLE 7

Average pigment gloss range of printing densities

| Type I color ramp | 2A | 2B | Type II color ramp | 2A | 2B |
|---|---|---|---|---|---|
| Cyan | 15.6 | 11.6 | Blue | 25.8 | 15.2 |
| Gray | 83.0 | 39.7 | Cyan | 23.4 | 14.3 |
| Light Cyan | 30.2 | 18.1 | Green | 26.8 | 15.2 |
| Light Magenta | 53.4 | 24.6 | Magenta | 27.8 | 12.2 |
| Magenta | 20.9 | 13.6 | Orange | 32.3 | 14.1 |
| Yellow | 29.1 | 17.0 | Red | 28.1 | 14.3 |
| Black | 62.3 | 31.8 | Yellow | 35.2 | 13.3 |

As can be seen by Table 7, the samples associated with the 2A formulation has significantly higher gloss than the 2B formulation, both for primary colors in the Type I color ramp, and for secondary colors as seen in the Type II color ramp. In Table 7, a larger number indicates a more desirable property, as it indicates a higher gloss. Though not listed, Samples 1A and 1B as well as samples 3A and 3B behaved similarly.

Another attribute of image quality is gloss uniformity, i.e. how gloss differs from each different step in a color ramp or across different color ramp. In this case, a standard deviation of the measured gloss ramp is partially reflected in gloss uniformity. As such, standard deviations were determined for each ink, and representative samples are shown in Table 8 below:

TABLE 8

Pigment gloss uniformity over range of printing densities

| | 1A | 1B | 2A | 2B | 3A | 3B |
|---|---|---|---|---|---|---|
| Ink 1 (Green) | 4.2 | 9.7 | 6.3 | 15.4 | 5.7 | 15.1 |
| Ink 2 (Red) | 10.4 | 16.3 | 12.3 | 20.5 | 9.4 | 20.1 |
| Ink 3 (Yellow) | 6.9 | 13.0 | 6.8 | 14.0 | 6.5 | 13.7 |

As can be seen by Table 8, Samples 1A, 2A, and 3A outperformed Control Samples 1B, 2B, and 3B, respectively.

In this test, a lower number is more desirable, as from low density printing to high density printing, the difference in gloss is kept to a lower deviation.

b) Dye Gamut

A proprietary dye-based ink-jet ink (Ink 4) was prepared to determine dye gamut and optical density in accordance with embodiments of the present invention. Specifically, the ink-jet ink was printed on each media sample (1-3A and 1-3B) and tested for dye gamut and optical density. The L*a*b*8 point gamut data is provided in Table 9, as follows:

TABLE 9

| | Dye gamut | | | | | |
|---|---|---|---|---|---|---|
| | 1A | 1B | 2A | 2B | 3A | 3B |
| Ink 4 (Dye) | 388578 | 344360 | 384916 | 334633 | 392614 | 341325 |

As can be seen be Table 9, there was about a 15% increase in dye gamut when an image was printed on Samples 1A, 2A, and 3A compared to Control Samples 1B, 2B, and 3C, respectively.

c) Humid Bleed

A dye-based ink-jet ink (Ink 5) available commercially in the HP Deskjet 970 ink-set was printed on the various media samples (1A, 2A, 1B, 2B, 3A, and 3B) and tested for humid bleed. In each case, a 1.0 mm line was printed and the printed media samples were put in an 80% relative humidity environment at 30° C. for 48 hours. The spreading of the line due to the humidity was measured in mils, and is provided in Table 10 below:

TABLE 10

| | humid bleed | | | | | |
|---|---|---|---|---|---|---|
| | 1A | 1B | 2A | 2B | 3A | 3B |
| Ink 5 (Dye) | 2.8-4.2 | 5.8-9.4 | 0.8-4.2 | 5.8-9.4 | 2.8-4.2 | 5.8-9.4 |

As can be seen by Table 10, the humid bleed is significantly lower when ink-jet ink is printed on a media sheet washed in accordance with embodiments of the present invention.

d) Media Brittleness

The six media samples (1A, 2A, 1B, 2B, 3A, and 3B) were each wrapped around cylindrical dowels to determine the flexibility of the coating material on the media substrate, as well as to determine the point at which the coating material would begin to crack. Samples 1A, 2A, and 3A could each be wrapped around a cylindrical dowel having a radius of 50 mm before cracking would begin. Control Samples 1B, 2B, and 3B started to crack when wrapped around cylindrical dowels having a radius larger than about 150 mm.

e) Ink Capacity

Samples 1A, 2A, and 3A were compared to Control Samples 1B, 2B, and 3B to determine which had a greater ink capacity, respectively. Each of Samples 1A, 2A, and 3A had a porosity of 0.95 $cm^3$/gram of coating. Control Samples 1B, 2B, and 3C had a porosity of 0.91 $cm^3$/gram of coating. Thus, the washed samples had an increased ink receiving capacity compared to the samples that were not washed in accordance with embodiments of the present invention.

Example 9

Refining ACH-Treated Silica Prior to Coating on Media Substrate

An ACH treated silica is prepared by the method described in Example 1. The final wt % of solids is adjusted to about 20%, and the pH of the silica is adjusted to about 3.0. A Vivaflow 200 (by Vivascience, Germany) tangential flow (or cross flow) diafiltration module is used to remove the electrolytes from the silica dispersion. About one liter of the 20% ACH treated silica is then charged to a two liter Erlenmeyer flask, and the flask was immersed to a constant temperature bath at 50° C. The diafiltration is carried out using a 50,000 MWCO polyethersulfone membrane, and a Cole-Parmer peristatic pump-head accepting size 15 tubing and a pressure gauge are attached. The heated silica dispersion is pumped through the membrane and the back pressure is controlled at from 20 psi to 30 psi. To maintain a constant volume and constant solid of the fluid, a reservoir containing deionized water is connected to the system. As water/salt passes through the membrane, the vacuum that is created in the sample reservoir draws deionized water in exchange through the feed tubing from the feed reservoir. The conductivity of the waste aqueous solution is monitored continuously. This process is continued until the conductivity of the waste solution is reduced to within 20% of the original dispersion conductivity. In general, this is accomplished with an exchange volume of approximately 5 times of the original sample volume. The cleaned silica dispersion is recovered and cooled to room temperature. Alternatively, reduction is conductivity can be measured based on a decrease in the original conductivity of the coating solution to 20%. Once the cleaned silica dispersion is formed, it can be admixed with a binder composition and coated on a media substrate. By following this process, the conductivity of the particles in the coating composition can be reduced anywhere from about 25% to 75%, which is significant with respect to ink or dye interaction with these coatings.

Example 10

Wash Conductivity of Media Samples

Media Samples 1A, 1B, 2A, 2B, 3A, and 3B of Example 8, and the media sample of Example 9 were tested for wash conductivity by cutting a area of 100 square centimeters (10 cm×10 cm), immersing each sample in 50 ml of deionized water in a glass tray, agitating for 45 second, and measuring conductivity of the water after removal of the media samples by using a water conductivity meter. The results of the wash conductivity tests are provided in Table 11, as follows:

TABLE 11

| Media Sample | Wash conductivity (microsiemens/cm) |
|---|---|
| Example 8, Sample 1A | 54 |
| Example 8, Sample 1B | 194 |
| Example 8, Sample 2A | 58.9 |
| Example 8, Sample 2B | 202 |
| Example 8, Sample 3A | 42 |
| Example 8, Sample 3B | 198 |
| Example 9 | 45 |

As can be seen from Table 11 above, media Samples 1A, 2A, and 3A of Example 8 as well as the media sample from Example 9, all have wash conductivities below about 80 microsiemens/cm, even though the coatings were formulated with a water soluble coating formulation additive. Samples 1B, 2B, and 3B of Example 8 all have wash conductivities of about 200 microsiemens/cm.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A media sheet for ink-jet printing, comprising:

a) a media substrate; and b) a coating composition applied to the media substrate to form an ink-receiving layer, said ink-receiving layer including:

i) semi-metal oxide or metal oxide particulates, ii) binder, and iii) at least 5 wt % of an aluminum chlorohydrate associated with the semi-metal oxide or metal oxide particulates, or associated with the binder, said media sheet having a wash conductivity less than about 80 microsiemens/cm, said wash conductivity determined by measuring the conductivity of a 50 mL bath of deionized water after placing a 100 $cm^2$ sample of the media sheet in the deionized water for 45 seconds at room temperature under agitation.

2. A media sheet as in claim 1, further including a water soluble coating formulation additive selected from the group consisting of ionic mordants, ionic multivalent ions, acidic components, crosslinking agents, organic salts, inorganic salts, and combinations thereof.

3. A media sheet as in claim 2, wherein the water soluble coating formulation additive is an aluminum salt.

4. A media sheet as in claim 2, wherein the water soluble coating formulation additive is boric acid or a borate salt.

5. A media sheet as in claim 1, further including a water soluble coating formulation additive that is a trivalent or tetravalent metal oxide, said metal being selected from the group consisting of aluminum, chromium, gallium, titanium, and zirconium.

6. A media sheet as in claim 1, wherein the wash conductivity is achieved by removing at least a portion of any unreacted aluminum chlorohydrate from the coating composition before applying the ink-receiving layer.

7. A media sheet as in claim 6, wherein the at least a portion of any unreacted aluminum chlorohydrate is removed from the coating composition by ultrafiltration, dialysis, ion exchange, or reverse osmosis.

8. A media sheet as in claim 1, wherein the wash conductivity is achieved by removing at least a portion of any unreacted aluminum chlorohydrate from the ink-receiving layer.

9. A media sheet as in claim 8, wherein the at least a portion of any unreacted aluminum chlorohydrate is removed from the ink-receiving layer by washing.

10. A media sheet as in claim 1, wherein metal or semi-metal oxide is silica

11. A media sheet as in claim 1, wherein metal or semi-metal oxide is alumina.

12. A media sheet as in claim 1, wherein the binder includes a member selected from the group consisting of polyvinyl alcohol, modified polyvinyl alcohol, and combinations thereof.

13. A media sheet as in claim 1, wherein the ink-receiving layer further includes an air fade additive configured to improve air fade resistance of an image printed on the porous media substrate.

14. A media sheet as in claim 13, wherein the air fade additive is selected front the group consisting of hindered amines, thio compounds, and combinations thereof.

15. A media sheet as in claim 1, wherein the porous surface has a pH from about 4 to about 7.5.

16. A method as in claim 1, wherein the ink-receiving layer has a pH from about 5 to about 6.

17. A media sheet as in claim 1, wherein the media substrate is selected from the group consisting of paper, overhead projector plastic, coated paper, fabric, art paper, water color paper, and photobase.

18. A media sheet as in, claim 1, wherein the media sheet is prepared by a) preparing a coating composition including metal or semi-metal oxide particulates, binder, and at least one water soluble coating formulation additive, wherein at least a portion of the water soluble coating formulation additive i) is in the form of unreacted additive or ii) generates undesired electrolytes;

b) applying the coating composition to a media substrate to form an ink-receiving layer; and c) removing at least a portion of the unreacted additive or undesired electrolytes either before or after applying the coating composition to the media substrate, wherein the ink-receiving layer includes at least 5 wt % of the water soluble coating formulation additive after the unreacted additive or undesired electrolytes are removed, and wherein at least a portion of the water soluble coating formulation additive of the ink-receiving layer is associated with the metal or semi-metal oxide particulates or the binder.

* * * * *